US009173530B2

(12) United States Patent
Fallat, II et al.

(10) Patent No.: US 9,173,530 B2
(45) Date of Patent: Nov. 3, 2015

(54) DISPENSING APPARATUS

(75) Inventors: Peter J. Fallat, II, Whitehouse Station, NJ (US); Lester R. Greer, Jr., Sandpoint, ID (US); Robert J. Croft, Jersey City, NJ (US); Martin C. Short, Jersey City, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 13/992,286

(22) PCT Filed: Dec. 17, 2010

(86) PCT No.: PCT/US2010/060982

§ 371 (c)(1),
(2), (4) Date: Jun. 7, 2013

(87) PCT Pub. No.: WO2012/082138

PCT Pub. Date: Jun. 21, 2012

(65) Prior Publication Data

US 2013/0264358 A1 Oct. 10, 2013

(51) Int. Cl.
*B67D 7/70* (2010.01)
*A47K 5/18* (2006.01)
(Continued)

(52) U.S. Cl.
CPC . *A47K 5/18* (2013.01); *A45D 34/04* (2013.01); *A47K 5/1205* (2013.01); *A47K 5/1217* (2013.01); *B01F 13/0023* (2013.01); *B01F 15/0087* (2013.01); *B01F 15/042* (2013.01); *B05C 17/00553* (2013.01); *B05C 17/0103* (2013.01); *B65D 81/325* (2013.01);
(Continued)

(58) Field of Classification Search
CPC ..... B65D 81/325; B65D 83/0011
USPC ..... 222/136, 325, 333, 145.1, 390; 401/175
See application file for complete search history.

(56) References Cited

U.S. PATENT DOCUMENTS 2,532,480 A 12/1950 Cannon
2,580,899 A 1/1952 Easton
(Continued)

FOREIGN PATENT DOCUMENTS

CN 101234006 8/2008
JP S49-114028 9/1974
(Continued)

OTHER PUBLICATIONS

Croft, Rob, Advanced Toothpaste Delivery System, Brandpackaging, Mar. 2006.
(Continued)

*Primary Examiner* — Daniel R Shearer

(57) ABSTRACT

Disclosed is a dispensing apparatus for dispensing a multi-component composition such as an oral care composition. The apparatus comprises a plurality of compartments, each containing a respective component of an composition, an orifice communicating with the plurality of compartments, and a common electrical drive mechanism for simultaneously dispensing the respective components from the plurality of compartments through the orifice. The electrical drive mechanism may comprise a single motor. Each compartment may include a respective piston for extruding a respective component of the composition from the apparatus, the pistons of the plurality of compartments being driven by a common gear mechanism coupled to the motor.

26 Claims, 7 Drawing Sheets

(51) Int. Cl.

| | |
|---|---|
| ***B65D 83/00*** | (2006.01) |
| ***B65D 81/32*** | (2006.01) |
| ***A45D 34/04*** | (2006.01) |
| ***A47K 5/12*** | (2006.01) |
| ***B01F 13/00*** | (2006.01) |
| ***B01F 15/00*** | (2006.01) |
| ***B01F 15/04*** | (2006.01) |
| ***B05C 17/005*** | (2006.01) |
| ***B05C 17/01*** | (2006.01) |
| *A45D 40/04* | (2006.01) |
| *A45D 40/24* | (2006.01) |

(52) U.S. Cl.

CPC ..... *B65D83/0011* (2013.01); *A45D 40/04* (2013.01); *A45D 40/24* (2013.01); *A45D 2200/055* (2013.01)

(56) References Cited

U.S. PATENT DOCUMENTS

| | | | | |
|---|---|---|---|---|
| 3,087,653 | A | 4/1963 | Nolin | |
| 3,198,389 | A | 8/1965 | Dunning | |
| 3,274,632 | A * | 9/1966 | Franklin | 15/29 |
| 3,581,943 | A | 6/1971 | Koenigshof et al. | |
| 3,729,553 | A | 4/1973 | Gold et al. | |
| 3,738,533 | A | 6/1973 | Bertrand | |
| 3,774,816 | A * | 11/1973 | Bratton | 222/391 |
| 4,046,288 | A * | 9/1977 | Bergman | 222/135 |
| 4,213,543 | A | 7/1980 | Thiem | |
| 4,226,336 | A | 10/1980 | Young | |
| 4,234,104 | A | 11/1980 | Apuzzo, Jr. et al. | |
| 4,240,566 | A * | 12/1980 | Bergman | 222/135 |
| 4,258,864 | A | 3/1981 | Karamanolis et al. | |
| 4,273,269 | A * | 6/1981 | Davis, Jr. | 222/326 |
| 4,403,714 | A | 9/1983 | Kane | |
| 4,418,840 | A | 12/1983 | Gardner | |
| 4,508,242 | A | 4/1985 | Wolfe | |
| 4,687,663 | A | 8/1987 | Schaeffer | |
| 4,773,562 | A | 9/1988 | Geuret | |
| D315,496 | S | 3/1991 | Pettengill | |
| 5,020,694 | A | 6/1991 | Pettengill | |
| 5,038,963 | A | 8/1991 | Pettengill et al. | |
| 5,050,773 | A | 9/1991 | Choi | |
| D320,735 | S | 10/1991 | Pettengill | |
| 5,152,427 | A * | 10/1992 | Pope et al. | 222/23 |
| 5,199,610 | A | 4/1993 | Gagliardi | |
| 5,215,218 | A | 6/1993 | Choi | |
| 5,248,061 | A | 9/1993 | Weiselfish et al. | |
| 5,289,835 | A * | 3/1994 | Harlan et al. | 132/313 |
| 5,289,949 | A | 3/1994 | Gentile | |
| 5,289,950 | A | 3/1994 | Gentile | |
| 5,335,827 | A | 8/1994 | Gentile | |
| 5,346,132 | A * | 9/1994 | Hahn et al. | 239/71 |
| 5,392,947 | A | 2/1995 | Gentile | |
| 5,443,183 | A * | 8/1995 | Jacobsen et al. | 222/145.6 |
| 5,573,138 | A | 11/1996 | Lin | |
| 5,645,193 | A | 7/1997 | Gentile et al. | |
| 4,687,663 | B1 | 10/1997 | Schaeffer | |
| 5,845,813 | A | 12/1998 | Werner | |
| 5,873,495 | A | 2/1999 | Saint-Germain | |
| 5,875,929 | A | 3/1999 | Nguyen | |
| 5,927,889 | A | 7/1999 | La Flower | |
| 5,975,362 | A | 11/1999 | West | |
| 6,105,823 | A * | 8/2000 | Seager et al. | 222/137 |
| 6,161,729 | A | 12/2000 | Gentile et al. | |
| 6,176,396 | B1 * | 1/2001 | Hamada et al. | 222/137 |
| 6,299,023 | B1 | 10/2001 | Arnone | |
| 6,345,733 | B1 | 2/2002 | Bennett | |
| 6,364,165 | B2 | 4/2002 | Sampson et al. | |
| 6,390,329 | B1 | 5/2002 | Maddox | |
| 6,401,977 | B1 | 6/2002 | Ross | |
| 6,401,978 | B1 | 6/2002 | Young | |
| 6,662,971 | B1 | 12/2003 | Nguyen et al. | |
| 6,761,285 | B2 | 7/2004 | Bertone | |
| 6,854,621 | B2 * | 2/2005 | Keller | 222/137 |
| 6,866,163 | B2 | 3/2005 | McGill | |
| 6,880,726 | B1 | 4/2005 | Perez | |
| 6,889,872 | B2 * | 5/2005 | Herman et al. | 222/82 |
| 6,948,638 | B2 | 9/2005 | Tu | |
| 6,957,925 | B1 | 10/2005 | Jacobs et al. | |
| 7,011,467 | B1 | 3/2006 | Fiore et al. | |
| 7,213,995 | B2 | 5/2007 | Bravo-Loubriel | |
| 7,673,819 | B2 * | 3/2010 | Lind et al. | 239/690 |
| 8,002,487 | B2 * | 8/2011 | Wise et al. | 401/265 |
| 8,038,037 | B2 * | 10/2011 | deVirag et al. | 222/333 |
| 8,393,813 | B2 * | 3/2013 | Yarlagadda | 401/52 |
| 8,418,891 | B1 * | 4/2013 | Harris | 222/333 |
| 2003/0080152 | A1 * | 5/2003 | Balcome et al. | 222/136 |
| 2005/0127099 | A1 | 6/2005 | Chou | |
| 2006/0210352 | A1 | 9/2006 | Clark | |
| 2006/0222451 | A1 | 10/2006 | Glassman | |
| 2007/0041779 | A1 | 2/2007 | Kuo | |
| 2007/0084880 | A1 | 4/2007 | Wagner et al. | |
| 2008/0121651 | A1 * | 5/2008 | deVirag et al. | 222/63 |
| 2008/0121656 | A1 * | 5/2008 | deVirag et al. | 222/135 |
| 2008/0237259 | A1 | 10/2008 | Fuchs | |
| 2009/0045223 | A1 * | 2/2009 | Laidler et al. | 222/108 |
| 2009/0052970 | A1 * | 2/2009 | Jung | 401/152 |
| 2009/0277970 | A1 * | 11/2009 | Lind et al. | 239/3 |
| 2009/0314809 | A1 | 12/2009 | Lederle et al. | |
| 2014/0092704 | A1 | 4/2014 | Janssen et al. | |

FOREIGN PATENT DOCUMENTS

| | | |
|---|---|---|
| JP | H05-000679 | 1/1993 |
| JP | 2002-308355 | 10/2002 |
| JP | 2009-132424 | 6/2009 |
| TW | 200305540 | 11/2003 |
| TW | M359688 | 6/2009 |
| WO | WO 03006331 | 1/2003 |
| WO | WO 2007/144793 | 12/2007 |
| WO | WO 2009141489 | 11/2009 |

OTHER PUBLICATIONS

International Search Report and the Written Opinion of the International Searching Authority issued in International Application PT/US2010/060982 mailed Sep. 30, 2011.

Official Action dated Sep. 25, 2014 in corresponding RU Application No. 2013132973, filed Dec. 17, 2010. RU.

* cited by examiner

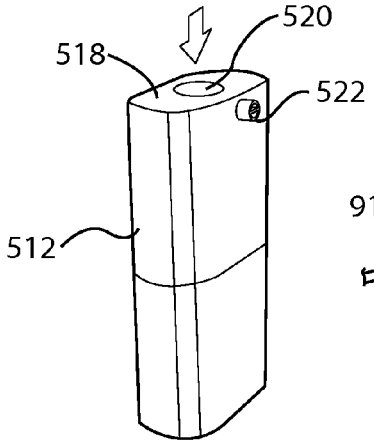
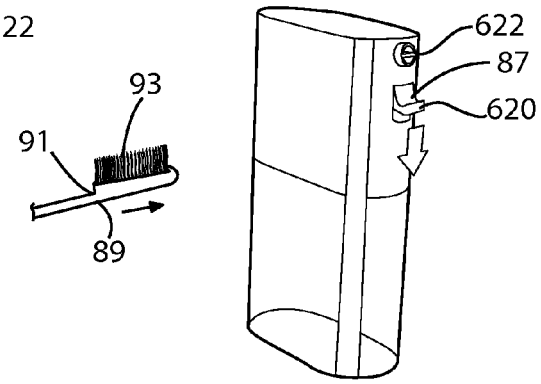
FIG. 5
FIG. 6
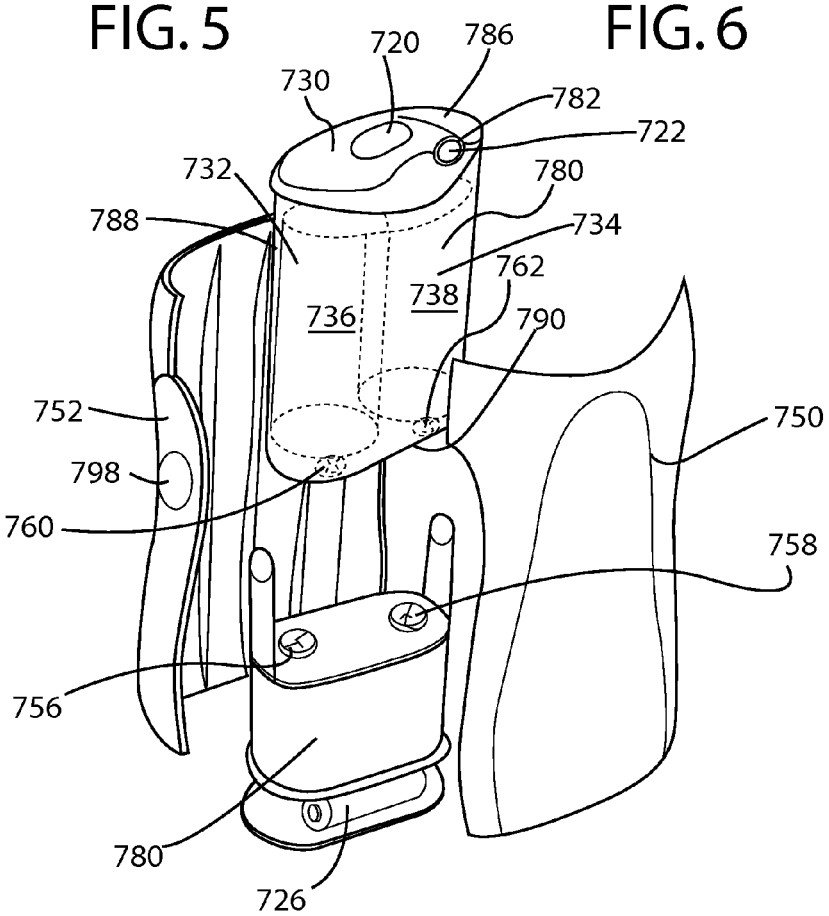
FIG. 7

DISPENSING APPARATUS

CROSS-REFERENCE OF RELATED APPLICATIONS

This application is a U.S. national stage entry under 35 U.S.C. §371 of Patent Cooperation Treaty Patent Application No. PCT/US2010/060982, filed Dec. 17, 2010, the entirety of which is incorporated herein by reference.

FIELD OF THE INVENTION

The present invention relates to a dispensing apparatus for dispensing a composition such as a personal care composition, for example a liquid soap, or an oral care composition, for example a dentifrice composition such as a toothpaste or gel.

BACKGROUND OF THE INVENTION

It is well known to provide a variety of different dispensers for compositions, such as liquid soaps, toothpastes or gels. For example, liquid soaps, toothpastes or gels may be packaged in deformable tubes or pump dispensers which are operated manually to dispense a desired amount of the composition. Some compositions comprise first and second components which are required to be packaged separately, to avoid any reaction between respective ingredients in the two components prior to use. For example, an oral care composition may comprise a first component comprising sodium bicarbonate and a second component comprising a whitening agent such as hydrogen peroxide. When the oral care composition is dispensed, the two components are intended to be dispensed in a particular volume ratio, and subsequently mixed during use. It is important to try to ensure that the two components are dispensed in the desired volume ratio so as to achieve the desired efficacy, active concentration (when an active is on only one of the two compartments) and avoid material waste.

It is known to package some multi-component compositions in deformable and collapsible tubes. However, it can be difficult for the user to ensure that the required dispensing ratio is repeatably and consistently achieved, due to unequal manual pressure being applied to different portions of the tube and to different flow characteristics of the plural components. Consequently, pump dispensers were developed for such multi-component compositions. Such pump dispensers employ mechanical pressure, pressurised gas or electrical motors to dispense the compositions.

Despite these known containers, there is a need in the art for a dispenser for compositions, such as liquid soap, toothpaste or gel, which can repeatably dispense desired amounts, for example equal amounts by volume, of the individual components of dual-component compositions.

There is also a need in the art for a dispenser for compositions which is easy to use, particularly by children and senior citizens.

BRIEF SUMMARY OF THE INVENTION

According to one embodiment of the invention there is provided a dispensing apparatus for dispensing a multi-component composition, the apparatus comprising a plurality of compartments, each containing a respective component of an composition, an orifice communicating with the plurality of compartments, and a common electrical drive mechanism for simultaneously dispensing the respective components from the plurality of compartments through the orifice.

Optionally, in some embodiments the electrical drive mechanism comprises a single motor. Typically, each compartment includes a respective piston for extruding a respective component of the composition from the apparatus, the pistons of the plurality of compartments being driven by a common gear mechanism coupled to the motor. The electrical drive mechanism may include a controller for controlling a dose of at least one of the components in a single dispensing cycle.

Optionally, in some embodiments the plurality of compartments are comprised in a detachable cartridge assembly which is removably attached to the electrical drive mechanism. The detachable cartridge assembly may include the orifice for the dispensed composition. The detachable cartridge assembly may include a head member comprising a plurality of chambers, each associated with a respective compartment, and a plurality of outlet conduits, each extending from a respective chamber, the outlet conduits converging to form a common outlet. Typically, the outlet conduits are of substantially equal length.

In some embodiments, the plurality of chambers may comprise two chambers in a side-by-side relationship with a centrally located outlet therebetween.

In some embodiments, the detachable cartridge assembly may include an outer surface of the dispensing apparatus.

In some embodiments, the electrical drive mechanism may have a self-centering action, for example by including a plurality of clutch members, each detachably mating with a respective drive element associated with a respective compartment. Typically, the clutch members and the drive elements each have a spiral flute construction.

In some embodiments, the dispensing apparatus may further comprise a housing enclosing the plurality of compartments and the electrical drive mechanism. The housing may have a substantially oval cross-section. The dispensing apparatus may further comprise an actuator button on an upper surface of the housing. The actuator button may comprise the entire upper surface of the housing.

In one embodiment, the dispensing apparatus may further comprise a nozzle on the housing for dispensing the composition, and an actuator button on a side surface of the housing located beneath the nozzle.

In some embodiments, the dispensing apparatus may further comprise an indicator for indicating an amount of at least one component of the composition remaining in a respective compartment of the apparatus. The indicator may include an illuminated display.

In some embodiments, the indicator may be adapted to respond to a sensed location of a part of the drive mechanism. Alternatively, the indicator may be adapted to respond to a pressure applied to a component of the composition. Alternatively, the indicator may be adapted to respond to a resistance force applied to the drive mechanism.

In some embodiments, the indicator includes a window for viewing at least one compartment. The window may view a side of the at least one compartment. Alternatively, the window may view an exit end of the at least one compartment.

In some embodiments, the apparatus may have an anti-drool structure, for example by providing that the orifice is self-closing to prevent oozing or drool of the composition from the orifice when the drive mechanism is stopped after a dispensing cycle.

In some embodiments, an alternative anti-drool structure is present, for example by providing that the drive mechanism is adapted to provide a forward drive during a dispensing cycle, and a reverse drive to lower any pressure acting on the composition within the compartments at the end of each dispensing cycle.

In some embodiments, an alternative anti-drool structure is present, for example by providing that the compartment includes a rigid container having a flexible portion to accommodate excess pressure within the compartment on termination of the dispensing.

In some embodiments, the indicator comprises at least two different components of the composition which have a mutually different visual appearance and are sequentially disposed in a single compartment.

In some embodiments, the composition is an oral care composition which fills the plurality of compartments. Typically, the plurality of compartments are respectively filled with a plurality of dentifrice components. The dentifrice components typically comprise toothpaste.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 5 is a schematic perspective view of a dispenser in accordance with a second embodiment of the present invention.

FIG. 6 is a schematic perspective view of a dispenser in accordance with a third embodiment of the present invention.

FIG. 7 is a schematic perspective view, in exploded form, of a dispenser in accordance with a fourth embodiment of the present invention.

DETAILED DESCRIPTION OF THE INVENTION

The following description of the preferred embodiment(s) is merely exemplary in nature and is in no way intended to limit the invention, its application, or uses.

It should be understood that the detailed description and specific examples, while indicating embodiments of the invention, are intended for purposes of illustration only and are not intended to limit the scope of the invention.

The following definitions and non-limiting guidelines must be considered in reviewing the description of this invention set forth herein. The headings (such as "Background of the Invention" and "Summary,") used herein are intended only for general organization of topics within the disclosure of the invention, and are not intended to limit the disclosure of the invention or any aspect thereof. In particular, subject matter disclosed in the "Background of the Invention" may include aspects of technology within the scope of the invention, and may not constitute a recitation of prior art. Subject matter disclosed in the "Summary" is not an exhaustive or complete disclosure of the entire scope of the invention or any embodiments thereof.

The citation of references herein does not constitute an admission that those references are prior art or have any relevance to the patentability of the invention disclosed herein. Any discussion of the content of references cited in the Background of the Invention is intended merely to provide a general summary of assertions made by the authors of the references, and does not constitute an admission as to the accuracy of the content of such references.

The detailed description, while indicating embodiments of the invention, is intended for purposes of illustration only and is not intended to limit the scope of the invention. Moreover, recitation of multiple embodiments having stated features is not intended to exclude other embodiments having additional features, or other embodiments incorporating different combinations the stated of features.

As used herein, the words "preferred" and "preferably" refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the word "include," and its variants, is intended to be non-limiting, such that recitation of items in a list is not to the exclusion of other like items that may also be useful in the dispensers of this invention.

Figure 1:
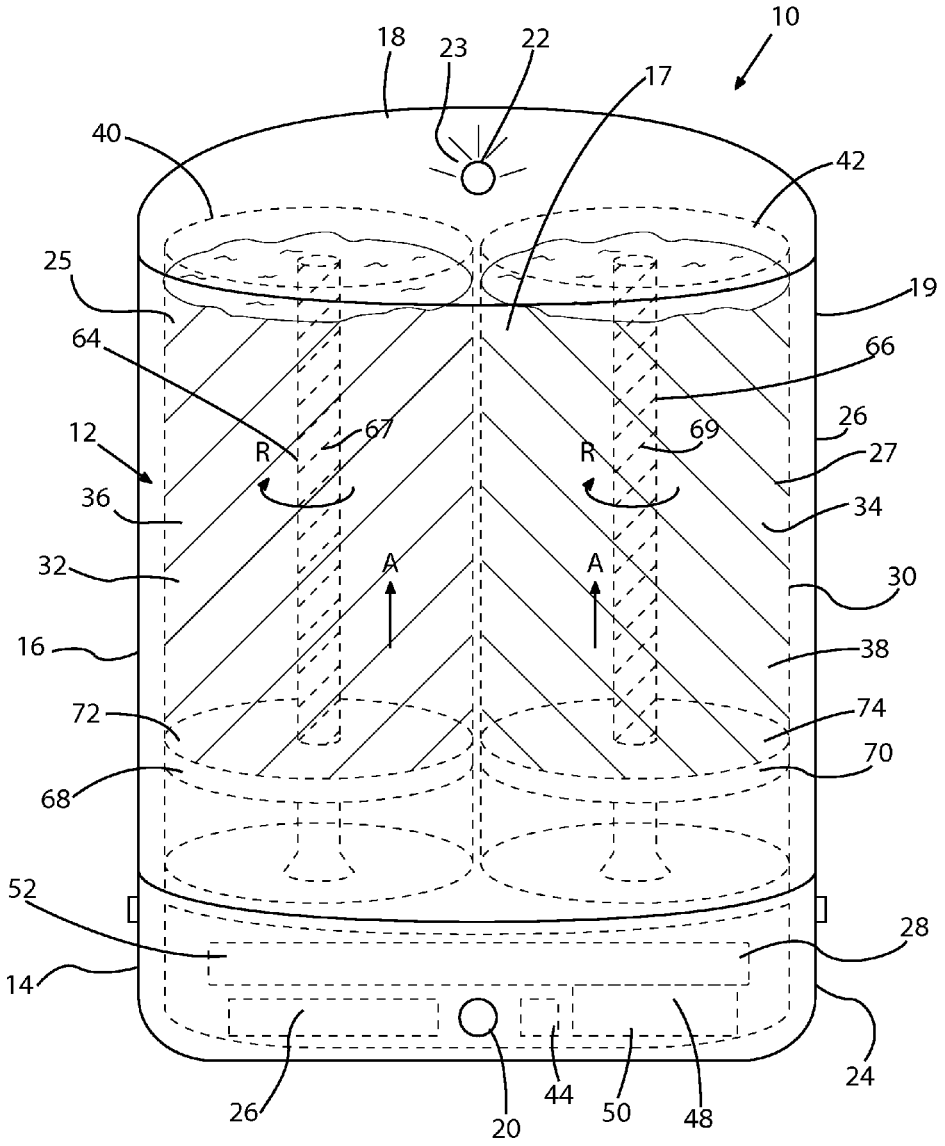
FIG. 1 schematically illustrates a perspective front view, partly in phantom, of a dispenser in accordance with a first embodiment of the present invention.

FIG. 1 schematically illustrates a perspective front view, partly in phantom, of a dispenser, designated generally as 10, in accordance with a first embodiment of the present invention. The dispenser 10 comprises a housing 12 having a base 14 shaped so that the dispenser 10 may be stood upright in a stable manner by placing the base 14 on a horizontal surface such as a bathroom shelf. The housing 12 has a side surface 16 and an upper surface 18. An actuating button 20 for dispensing a composition from the dispenser 10 is located in the base 14. A dispensing orifice 22 is located at an upper region of the housing 12, for example in the upper surface. The dispensing orifice 22 is typically located at the end of a protruding spout 23. Alternatively, the dispensing orifice 22 may be located at a junction between the side surface 16 and the upper surface 18. When the actuating button 20 is manually depressed, a composition is extruded out of the dispensing orifice 22.

The housing 12 comprises a lower part 24, which houses a power source 26 and drive mechanism 28, and an upper part 26 which houses a cartridge assembly 30 for the composition. The cartridge assembly 30 is removably fitted within the housing 12, and may be replaced when empty. The cartridge assembly 30 may be preloaded within the housing 12 and filled with a dual-component composition such as a toothpaste. The cartridge assembly 30 comprises two separate compartments 32, 34, each filled with a respective component 36, 38 of the dual-component composition. The two compartments 32, 34 communicate at their upper ends 40, 42 with the dispensing orifice 22 so that the dual component composition is dispensed from the dispensing orifice 22. A head member 71, shown in FIG. 4 but not shown in FIG. 1, caps the upper ends 40, 42 and communicates with the orifice 22. The two composition components 36, 38 may optionally be at least partially intermixed prior to exiting the dispensing orifice 22. In some embodiments the compartments are provided in separate cartridges whereas in other embodiments the compartments are provided in connected cartridges or a common cartridge assembly. The compartments may be shaped and dimensioned at their dispensing end, together with corresponding shaping and dimensioning of the orifice, based on the rheology of the composition to be dispensed.

Figure 4:
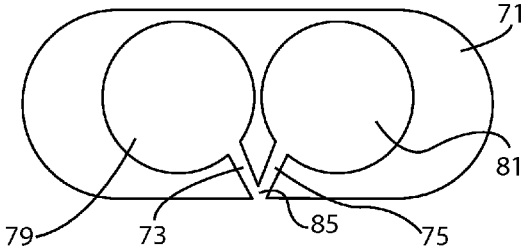
FIG. 4 is a plan view of the head of the cartridge assembly of the dispenser of FIG. 1.

Referring to FIG. 4, the two compartments 32, 34 are capped by a head member 71 with a respective outlet conduit 73, 75 leading away from a respective chamber 79, 81 above each compartment 32, 34. Preferably, the outlet conduits 73, 75 from the respective compartments 32, 34 are of substantially equal length to minimise differences in flow rates and back pressure. Typically therefore, the compartments 32, 34 are disposed in a side-by-side relationship, and two outlet conduits 73, 75 from the respective compartments 32, 34 converge to a centrally located outlet 85. This side-by side relationship in turn can readily be accommodated by utilizing a housing 12 having a substantially oval cross-section, the front and rear face 17, 19 optionally being planar and joined by rounded side faces 25, 27. The cross-sectional area of the interior cavity of the compartments 32, 34 is selected to provide a desired dosage.

Figure 2:
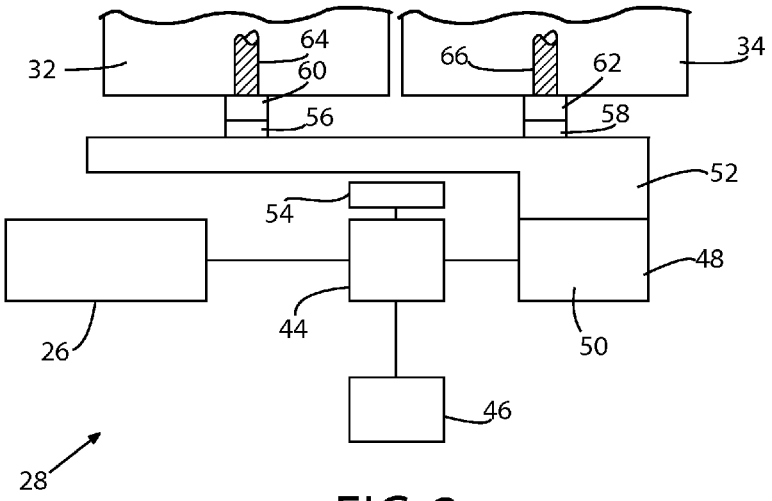
FIG. 2 is a schematic diagram of the drive system of the dispenser of FIG. 1.

Referring additionally to FIG. 2, the drive mechanism 28 comprises a controller 44 electrically coupled to the power source 26. The power source 26 may be a battery, an external plug-in power source, or a hybrid of these two. The power source 26 may comprise dry cell, disposable or rechargeable batteries, and/or a connection, such as a jack-plug socket, removable plug, wall plug or docking station, to a source of external electrical power. The power source 26 may be disposed with a dedicated sub-housing, which may be the base of the dispenser 10, which may be selectively separable from the remainder of the dispenser 10. A power indicator (not shown) may show the power level and thereby indicate when batteries need to be replaced or recharged.

An actuator 46, which is operated by the actuating button 20, is also coupled to the controller 44. A power device 48, comprising an electric rotational motor 50 and a gear mechanism 52 mounted thereto, is also coupled to the controller 44. A memory 54 is connected to the controller 44. The memory 54 stores data therein representing, directly or indirectly, a predetermined dispensed volume of each of the composition components 36, 38. The memory 54 is provided in this embodiment to provide dose control of the composition dispensed in any given dispensing cycle. A switch may be provided and connected to the controller 44 to alternate the dispensing between dosed dispensing and continuous dispensing.

The gear mechanism 52 commonly drives a pair of mutually spaced clutch members 56, 58, each coupled to a respective drive element 60, 62 of a respective compartment 32, 34. An elongate shaft 64, 66 extends longitudinally through a respective compartment 32, 34. Each elongate shaft 64, 66 has mounted thereon a respective piston 68, 70 which acts as a plunger within the respective compartment 32, 34. The piston 68, 70 is caused to move translationally along the respective compartment 32, 34 (in direction A) by rotation (in direction R) of the respective elongate shaft 64, 66. For example, each elongate shaft 64, 66 may be helically threaded, with the piston 68, 70 threadably coupled to the threaded shaft 64, 66. The composition components 36, 38 are disposed between the front face 72, 74 of the respective piston 68, 70 and the dispensing orifice 22 so that movement of the pistons 68, 70 along the respective compartment 32, 34 towards the dispensing orifice 22 causes dispensing of the dual-component composition.

In alternative embodiments, instead of providing a rotatable helical threaded connection between the elongate shaft 64, 66 and the respective piston 68, 70, a linear motion motor and actuator assembly may be employed to simultaneously drive two ratcheted rods, which thereby advance mated pistons in a ratchet stepwise manner, which pistons resist backward and downward motion as a result of the one-way ratchet mechanism.

A self-centering coupling between the electrical drive mechanism and the compartments may be provided.

Figure 3:
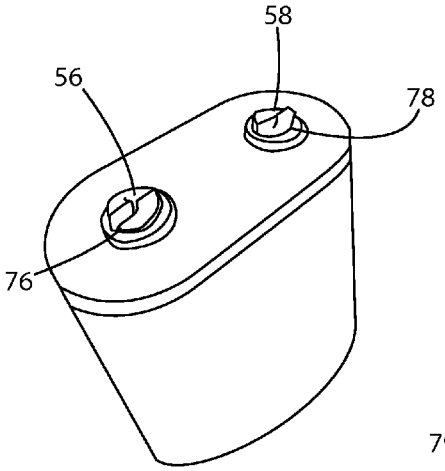
FIG. 3 is a schematic perspective top view of the clutch members of the drive system of the dispenser of FIG. 1.

As shown in FIG. 3, the clutch members 56, 58 each typically comprise a double spiral flute construction 76, 78, with the respective drive elements 60, 62 coupled thereto having a complementary double spiral flute construction for mating with the clutch members 56, 58. This clutch/drive element combination provides good power transfer from the gear mechanism 52 to the elongate shafts 64, 66, with minimum slippage in the driving direction. Since the cartridge assembly 30 is removably fitted within the housing 12, it is necessary to ensure efficient mechanical coupling between the drive elements 60, 62 on the cartridge assembly 30 and the clutch members 56, 58 substantially regardless of the precision of the alignment therebetween. The drive elements 60, 62 may vary slightly in position relative to the fixed position clutch members 56, 58 depending upon the accuracy of alignment of the cartridge assembly 30 within the housing 12.

When the actuator 46 is actuated by the manual operation of the actuating button 20, the controller 44 is caused to drive the motor 50 for a predetermined period, representing a number of rotations of the motor 50, corresponding to a predetermined dispensed volume of each of the composition components 36, 38. The controller 50 drives the motor 50 for a period determined by the data recorded in the memory 52. This ensures that the two pistons 68, 70 in the respective compartments 32, 34 are simultaneously driven by a common electrical drive system. This ensures repeatably controllable dispensing of the required volumes of the composition components 36, 38, from initial operation until the substantially final dispensing of the composition components 36, 38 remaining in the compartments 32, 34.

In a modification of this embodiment, the memory 54 is omitted and the user controls the volume of the dose of the composition dispensed in any given dispensing cycle by releasing the actuator button 20 after a desired amount of composition has been dispensed. In order to achieve effective user control of the dispensed composition dose, preferably the composition is delivered at a flow rate which is sufficiently low so that the user has a dispensing time period which is sufficiently long so that the user can readily have time to terminate dispensing without extruding an excessive dose. Also, a lower flow rate reduces back pressure in the compartments, and correspondingly reduces the likelihood of composition oozing out of the orifice under the action of residual pressure within the compartments.

In the illustrated embodiment, the gear mechanism 52 and helical threads 67, 69 on the shafts 64, 66 and pistons 68, 70 are configured to provide equal volumetric doses of the two composition components 36, 38 in each dispensing cycle. However, these elements may be modified to provide different volumetric doses of the two composition components 36, 38 in each dispensing cycle. This modification would be coupled to the use of corresponding different volumes for the compartments 32, 34 and the initial amounts of the composition components 36, 38 stored therein.

The two composition components 36, 38 may be delivered in a predetermined volume ration per dosage cycle. That ratio may be 1:1, i.e. the volumes are equal, or another ratio, i.e. the volumes are different. If the pistons 68, 70 are driven simultaneously at the same rate, then the volumes are different if the cross-sectional areas of the compartments 32, 34 are different.

When plural composition components 36, 38 are required to be accurately dispensed at a required volume ratio from respective composition compartments 32, 34 using a common drive mechanism, it is important that the drive mechanism and compartments are configured to provide an even and predictable flow of the composition components 36, 38. The construction of the head member 71 assists the achievement of even and predictable flow by providing outlet conduits of the same dimensions.

In the embodiment of FIG. 1 the housing 12 is adapted to be free-standing. However, it may be adapted to be wall-mounted.

Furthermore, the actuating button 20 may be located on any convenient exterior surface of the housing 12, not just on the base 14. As shown in FIG. 5, for example, in a further embodiment the actuating button 520 may be located on the upper surface 518, which may be easier to use by downward manual pressure. The actuating button 520 may comprise a major portion of the upper surface 520, or even the entire upper surface 520, of the housing 512.

The actuating button 20 may be a push button, a slider button or a rocker button. In some embodiments the actuating button 20 may be connected mechanically, rather than electrically, to the drive mechanism.

Two actuating buttons 20 may be provided, one on a respective opposite side of the housing 12, which may be independently or simultaneously operated to cause composition dispensing.

As shown in FIG. 6, in a further embodiment the actuating button 620 may be located beneath the dispensing orifice 622 and adapted to mate with a toothbrush head, for example having a cradle construction 87 for receiving a lower surface 89 of a toothbrush head 91. When the toothbrush head 91 is located in the cradle 87 and depressed, the actuating button 620 is depressed to switch the actuator 46. This causes the dual-component composition to be dispensed onto the tooth cleaning elements 93, such as bristles, of the toothbrush head 91. In a modified embodiment, the cradle may be arranged to receive an upper surface of a toothbrush head and be urged upwardly to dispense composition.

The cartridge assembly 30 is removably fitted within the housing 12. The two compartments 32, 34 are fitted together within the cartridge assembly 30 of the illustrated embodiments to provide a unitary structure.

Referring to FIG. 7, in a further embodiment a connecting structure 780 holds the two compartments 732, 734 together and provides an output conduit (not shown) for the composition, and the cartridge assembly 730 additionally comprises the dispensing orifice 722, typically in the form of a spout 782, at the dispensing end of the output conduit. Accordingly, a single replaceable cartridge assembly 730 is provided which includes the two compartments 732, 734, initially filled with two composition components 736, 738, and the dispensing orifice 722. The cartridge assembly 730 may also include the actuating button 720.

The cartridge assembly 730 generally comprises an assembly of a cartridge body 784 containing the two compartments 732, 734. The cartridge body 784 has an upper wall 786, a side wall 788 and a lower wall 790. The drive elements 760, 762 are rotationally mounted on the lower wall 790, and mate with the clutch members 756, 758. The cartridge assembly 730 is fitted onto the lower part 780 comprising the drive system and power source 726. The housing 712 comprises front and rear panels 750, 752 which are typically snap-fitted together. The top surface of the housing 712 is comprised of the upper wall 786 of the cartridge assembly 730, which includes the spout 782. On opposite sides of the housing 712, release buttons 798 are provided for releasing the cartridge assembly 730 from the remainder of the dispensing apparatus when either or both of the compartments 732,734 is exhausted.

However, in alternative embodiments the two compartments 32, 34 may be independent and separable. This may be advantageous since the consumer can replace each compartment separately, affording the possibility of the user to mix and match dentifrice products and/or flavours to their liking.

In further alternative embodiments, the compartments comprise a flexible sachet which contains the composition component. The drive system is adapted to operate one or more rollers which is moved progressively along the length of the flexible sachet thereby to squeeze the composition component out of the sachet.

Figure 8:
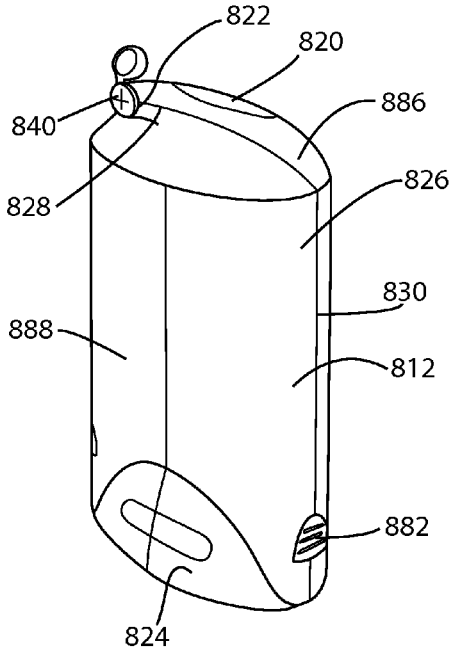
FIG. 8 is a schematic perspective view of a dispenser in accordance with a fifth embodiment of the present invention.
Figure 9:
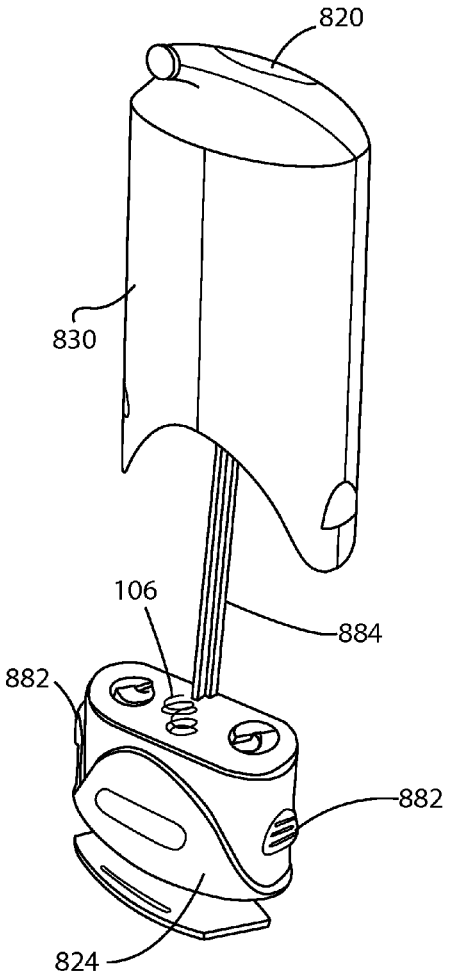
FIG. 9 is a perspective view of the dispenser of FIG. 8 when partly disassembled.

In some embodiments, the cartridge assembly 830 may comprise part of the housing 812, such as the upper part 826 as illustrated in FIGS. 8 and 9. In such a construction, the upper wall 886 and side wall 888 are part of the housing 812. The cartridge assembly 830 may be snap-fitted to the lower part 824, one or more cartridge release buttons 882 being provided in the housing 812 to enable release and replacement of the cartridge assembly 830 when at least one of the two composition components in the cartridge assembly 830 has become exhausted.

When the cartridge assembly 830 to be replaced comprises the actuating button 820, as shown in FIG. 9 a substantially rigid stem 884 may be provided extending from the controller located in the lower part 824. The stem 884 mounts the actuator which is to be operated by the actuating button 820 and the electrical connections therefrom to the controller. The stem 884 ensures that the actuator is correctly located adjacent to, and actuatable by, the actuating button 820 of the replacement cartridge assembly 830.

Furthermore, any of the embodiments of the invention may be provided with a self-closing orifice in the nozzle to prevent oozing or drool of the composition from the nozzle when the motor is stopped after a dispensing cycle.

For example, the orifice 822 in the spout 828 may be fitted with a valve member 840, for example composed of rubber, and an integral cover 842 which may be selectively moved from an open position, exposing the valve member 840, shown in FIG. 8 to a closed position, covering the valve member 840, shown in FIG. 9. Such a valve member may be used in any of the embodiments of the invention.

Another expedient to prevent drool of the composition from the nozzle when the motor is stopped after a dispensing cycle is for the controller to be adapted to provide a reverse drive to the motor at the end of each dosage cycle, in order slightly to reverse the direction of motion of the piston thereby to lower any pressure acting on the composition component within the compartment. Such a controller or function may be used in any of the embodiments of the invention. When such a reverse drive is provided, the coupling between the electrical drive mechanism and the dispensing mechanism in the compartments is structured to provide both forward and reverse drive functions, for example by modification of the clutch members 56, 58 shown in FIG. 3 to provide a reversible interconnection, as will be apparent to those skilled in the art.

In a further embodiment to prevent drool of the composition from the nozzle when the motor is stopped after a dispensing cycle, the compartment may be provided with a rigid container having a flexible portion, for example a flexible dome. The flexible portion may be provided at the top of the compartment, adjacent to the conduit communicating with the nozzle. The flexible portion can act to accommodate excess pressure within the compartment on termination of the dispensing, by flexing outwardly reducing the internal pressure.

Figure 10:
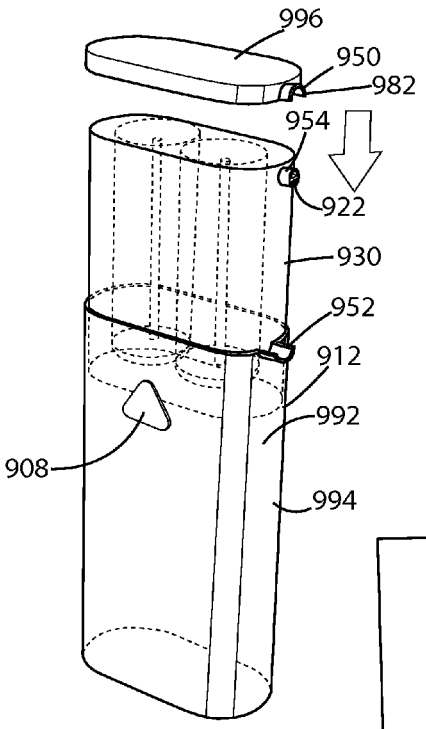
FIG. 10 is a schematic perspective view of a dispenser, when partly disassembled, in accordance with a sixth embodiment of the present invention.

In other embodiments, as shown in FIG. 10 the cartridge assembly 930 may be received within a cavity 992 defined within the housing 912, with two parts 994, 996 of the housing 912 being temporarily separable, typically by pressing at least one cartridge release button 908, to permit access to and replacement of the cartridge assembly 930.

The cartridge assembly 930 may be completely concealed within the housing 912, apart from the outlet orifice 922.

In this embodiment, the housing 912 is provided with a spout 982, separable into upper and lower halves 950, 952 when the cartridge 930 is being replaced, which is separate from the cartridge assembly 930. The cartridge assembly 930 has an outlet conduit 954 communicating with or located within the spout 982 when the cartridge assembly 930 is received with the housing 912.

Figure 11:
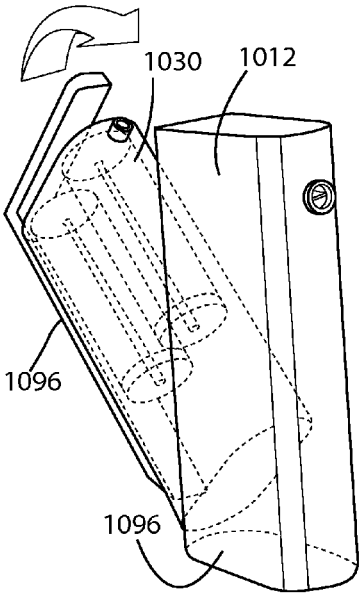
FIG. 11 is a schematic perspective view of a dispenser, when partly disassembled, in accordance with a seventh embodiment of the present invention.

In another embodiment, an integral upper and rear part 1094 of the housing 1012 may be hingedly connected to a main part 1096 of the housing 1012 to enable replacement of the cartridge assembly 1030 as illustrated in FIG. 11.

Figure 12:
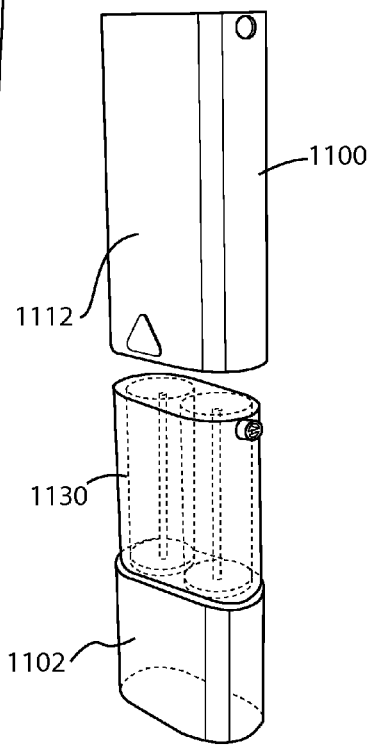
FIG. 12 is a schematic perspective view of a dispenser, when partly disassembled, in accordance with an eighth embodiment of the present invention.

In another embodiment, an upper and outer sleeve part 1100 of the housing 1112 may be slidably connected to a lower main part 1102 of the housing 1112 as illustrated in FIG. 12 to enable replacement of the cartridge assembly 1130.

In any of these embodiments a biasing mechanism, such as a spring, may be provided to assist release of the cartridge assembly from the housing 12 and/or opening of the housing 12. Such a spring 106 is illustrated in FIG. 9.

In a further aspect, the composition dispenser 10 may be provided with an indicator showing the depletion of composition within the two compartments 32, 34.

Figure 13:
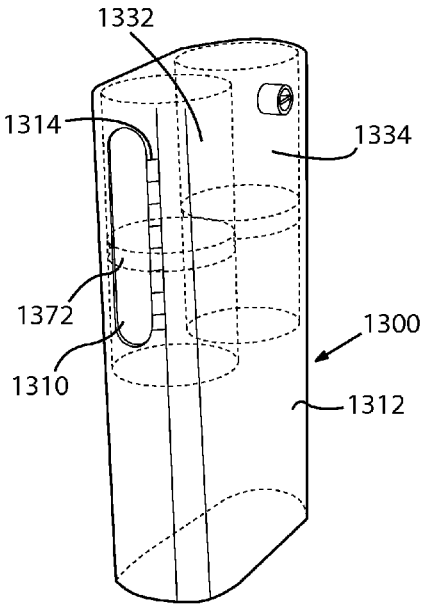
FIG. 13 is a schematic perspective view of a dispenser, in accordance with a ninth embodiment of the present invention.

In one embodiment, as shown in FIG. 13, the indicator 1310 comprises a transparent or translucent window 112 located in the housing 1312 at a location adjacent to at least one of the two compartments 1332, 1334. The respective compartment 1332, 1334 is transparent or translucent, so that user can readily see the vertical position of the piston 1372 and the level of the composition component remaining within the respective compartment 1332. The composition component may be colored for ease of visual inspection. A scale or marking 1314 may be formed on the window 112 or the surrounding portion of the housing 1312 of the dispensing apparatus 1300.

Figure 14:
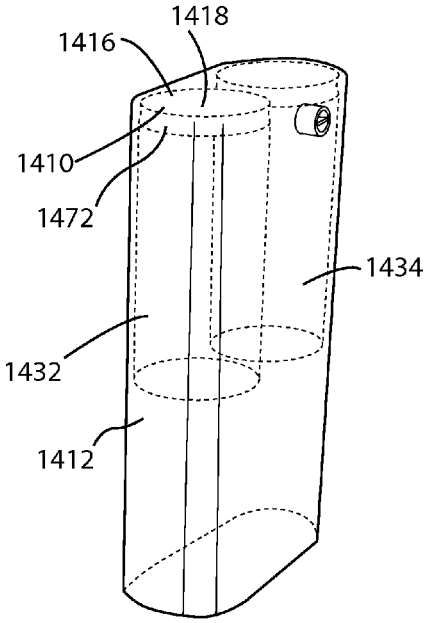
FIG. 14 is a schematic perspective view of a dispenser, in accordance with a tenth embodiment of the present invention.

In another embodiment, as shown in FIG. 14, the indicator 1410 comprises a transparent or translucent window 1416 located in the upper surface 1418 window of the housing 1412, so that a user can look down through the window 1418 and see the composition component remaining within either or both of the compartments 1432, 1434. The upper portion of the respective compartment 1432, 1434 is also transparent or translucent, so that user can readily see when the piston 1472 becomes visible at the top of the compartment 1432, indicating that the composition component remaining within the respective compartment 1432 has become exhausted. The piston 1472 may be colored, optionally being differently colored from the respective composition component, for ease of visual inspection.

Figure 15:
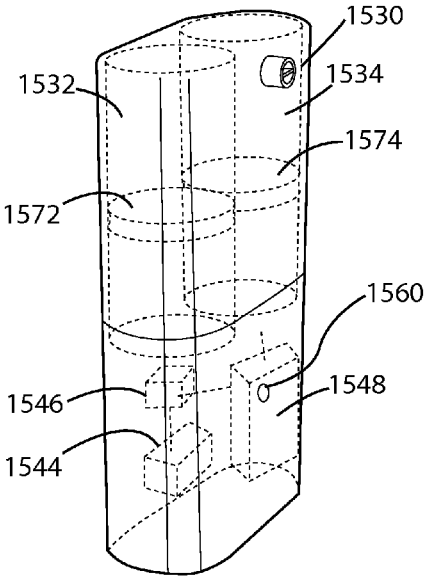
FIG. 15 is a schematic perspective view of a dispenser, in accordance with an eleventh embodiment of the present invention.

In another embodiment, as shown in FIG. 15, the controller 1544 is provided with sensing circuitry 1546 to sense when the motor 1548 has stalled, and cannot rotate further, due to at least one of the pistons 1572, 1574 being at the top of the respective compartment 1532, 1534 and unable to advance further. The controller 1544 is configured to illuminate an indicator element 1560, such as a light emitting diode (LED), forming a display when such stalling is sensed to indicate to the user that replacement of the cartridge assembly 1530 is required.

In a further embodiment, as also shown in FIG. 15, the controller 1544 is provided with sensing circuitry 1546 to sense a physical resistance applied to the motor 1548 to resist rotation of the motor 1548. As the compartments 1532, 1534 progressively empty, the pressure resistance against compression of the composition component remaining within the respective compartment 1532, 1534 progressively increases, up to a maximum value when the piston 1572,1574 is at the top of the respective compartment 1532, 1534 and unable to advance further. Again, the controller 1544 is configured to illuminate an indicator element 1560, such as one or more light emitting diodes (LED), when such resistance is sensed. The illumination level and/or color may vary depending upon the degree of resistance, a maximum illumination and/or particular color indicating to the user that replacement of the cartridge assembly 1530 is required.

Figure 16:
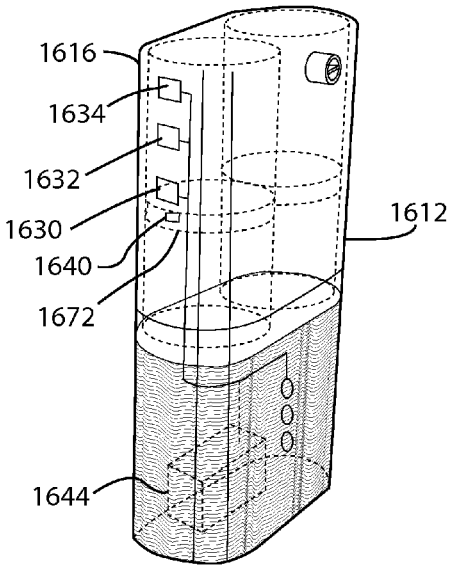
FIG. 16 is a schematic perspective view of a dispenser, in accordance with a twelfth embodiment of the present invention.

In a further embodiment, as shown in FIG. 16, a magnet 1640 may be located within at least one piston 1672. A series of contact elements 1630, 1632, 1634 are linearly disposed in series on the side wall 1616 of the housing 1612 extending along the direction of movement of the piston 1672. The contact elements 1630, 1632, 1634 are electrically connected to the controller 1644. As the piston 1672 progressively moves along the respective compartment 1632 during successive dispensing cycles for the composition component, the magnet 1640 sequentially passes the series of contact elements 1630, 1632, 1634. As the magnet 1640 passes each contact element 1630, 1632, 1634, the controller 1644 is triggered to illuminate a respective indicator element 1650, 1652, 1654, such as one or more light emitting diodes (LEDs). Different LEDs 1650, 1652, 1654 may be associated with different contact elements 1630, 1632, 1634, to provide a display which gives a clear and constant indication of the level of the composition component remaining in the respective compartment 1632.

Figure 17:
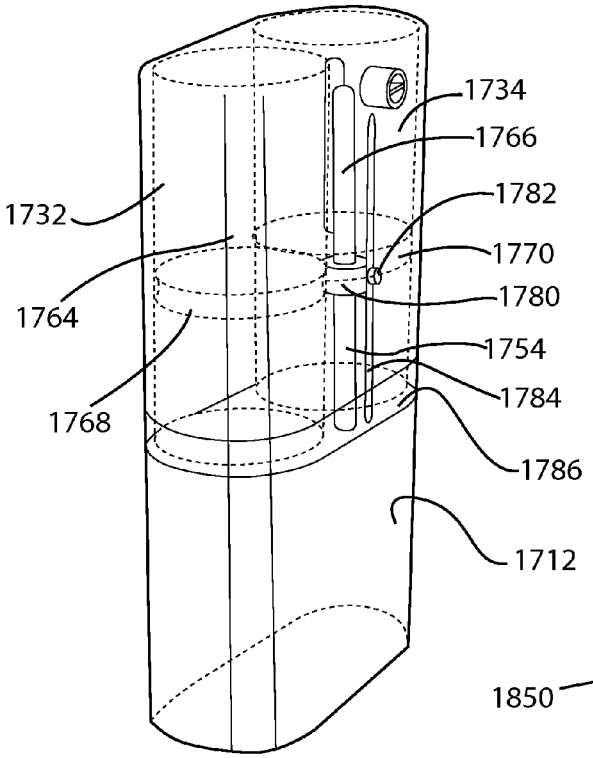
FIG. 17 is a schematic perspective view of a dispenser, in accordance with a thirteenth embodiment of the present invention.

In a still further embodiment, as shown in FIG. 17, the motor and gear mechanism are adapted to drive a third elongate shaft 1754, which is helically threaded, which extends parallel to the two threaded shafts 1764, 1766 coupled to the respective pistons 1768, 1770. The third shaft 1764 is located outside the two compartments 1732, 1734. A threaded indicator element 1780 is threadably coupled to the third shaft, and carries a slider 1782 which is arranged to slide vertically along a slot 1784 formed in the side wall 1786 of the housing 1712. As the pistons 1768, 1770 progressively move up the compartments 172, 1734, correspondingly the slider 1782 slides parallel therewith along the slot 1784, thereby indicating depletion of the composition components to the user.

Figure 18:
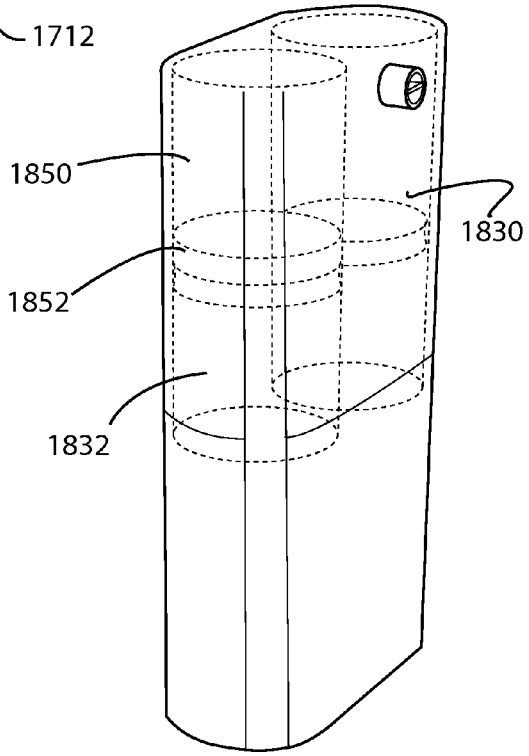
FIG. 18 is a schematic perspective view of a dispenser, in accordance with a fourteenth embodiment of the present invention.

In a yet further embodiment, as shown in FIG. 18, at least one of the compartments 1832 is filled with a major proportion of a primary composition component 1850 and a minor proportion of a secondary composition component 1852. The primary composition component 1850 is provided for dispensing throughout substantially all of the lifetime of the cartridge assembly 1830, whereas the secondary composition component 1852 is provided for dispensing at the very end of the lifetime of the cartridge assembly 1830, immediately prior, subject to a minimum number of remaining doses, to exhaustion of the respective compartment 1832. The primary and secondary composition components 1850,1852 are of different visual appearance, such as different color, so that a user can easily see that the composition component is about to become exhausted.

Various other modifications to the disclosed embodiments will be apparent to those skilled in the art.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

What is claimed is:

1. A dispensing apparatus for dispensing a multi-component composition, the apparatus comprising a housing including a first portion and a second portion that are detachably coupled together via a plurality of clutch members, wherein:

the first portion comprises:

a cartridge assembly comprising a plurality of compartments, each of the plurality of compartments containing a respective component of a composition, an orifice communicating with the plurality of compartments, and an actuating button; and the second portion comprises:

a base configured to be self-standing on a horizontal surface, a controller, and a common electrical drive mechanism that simultaneously dispenses the respective components from the plurality of compartments through the orifice;

the controller drives the common electrical drive mechanism to dispense a dose of each of the respective components in a single dispensing cycle in response to operation of the actuation button;

the plurality of clutch members a provide respective self-centering couplings between the electrical drive mechanism and respective shafts of the plurality of compartments that mate together the electrical drive mechanism and the respective shafts of the plurality of compartments;

the plurality of clutch members detachably mate with respective drive elements associated with the respective shafts of the plurality of compartments; and the plurality of clutch members provide power transfer with slippage to the respective shafts of the plurality of compartments.

2. The dispensing apparatus according to claim 1 wherein the electrical drive mechanism comprises a single motor.

3. The dispensing apparatus according to claim 1 wherein each of the plurality of compartments includes a respective piston that extrudes one of the respective components of the composition from the apparatus, the pistons of the plurality of compartments being driven by a common gear mechanism coupled to the motor.

4. The dispensing apparatus according to claim 1, further comprising a switch that alternates the common electrical drive mechanism between dosed dispensing and continuous dispensing.

5. The dispensing apparatus according to claim 1, wherein the the first portion further comprises a head member comprising a plurality of chambers, each associated with a respective one of the plurality of compartments, and a plurality of outlet conduits, each extending from a respective chamber, the outlet conduits converging to form a common outlet.

6. The dispensing apparatus according to claim 5 wherein the outlet conduits are of substantially equal length.

7. The dispensing apparatus according to claim 6 wherein the plurality of chambers comprises two chambers in a side-by-side relationship with a centrally located outlet therebetween.

8. The dispensing apparatus according to claim 7, wherein the the first portion comprises an outer surface of the dispensing apparatus.

9. The dispensing apparatus according to claim 1, wherein the housing has a substantially oval cross-section.

10. The dispensing apparatus according to claim 1, wherein:

the first portion further comprises a nozzle on the housing that dispenses the composition; and the actuator button is located on a side surface of the housing located beneath the nozzle.

11. The dispensing apparatus according to claim 1 further comprising an indicator that indicates an amount of at least one component of the composition remaining in a respective compartment of the apparatus.

12. The dispensing apparatus according to claim 11 wherein the indicator includes an illuminated display.

13. The dispensing apparatus according to claim 11 wherein he indicator is adapted to respond to a sensed location of a part of the drive mechanism.

14. The dispensing apparatus according to claim 11 wherein the indicator is adapted to respond to a pressure applied to a component of the composition.

15. The dispensing apparatus according to claim 11 wherein the indicator is adapted to respond to a resistance force applied to the drive mechanism.

16. The dispensing apparatus according to claim 11 wherein the indicator includes a window for viewing at least one compartment.

17. The dispensing apparatus according to claim 16 wherein the window views a side of the at least one compartment.

18. The dispensing apparatus according to claim 16 wherein the window views an exit end of the at least one compartment.

19. The dispensing apparatus according to claim 11 wherein the indicator comprises at least two different components of the composition which have a mutually different visual appearance and are sequentially disposed in a single compartment.

20. The dispensing apparatus according to claim 1 wherein the orifice comprises a self-closing orifice that prevents oozing or drool of the composition from the orifice when the drive mechanism is stopped after each of a plurality of dispensing cycles.

21. The dispensing apparatus according to claim 1 wherein the drive mechanism provides a forward drive during a dispensing cycle, and a reverse drive to lower any pressure acting on the composition within the compartments at the end of each of a plurality of dispensing cycles.

22. The dispensing apparatus according to claim 1 wherein the composition is an oral care composition which fills the plurality of compartments.

23. The dispensing apparatus according to claim 1 wherein the plurality of compartments are respectively filled with a plurality of dentifrice components.

24. The dispensing apparatus according to claim 23, wherein the dentifrice components comprise toothpaste.

25. A system for dispensing a multi-component composition comprising:

a housing having a base configured to be self-standing on a horizontal surface;

a cartridge assembly positioned within the housing, the cartridge assembly comprising:

a first compartment containing a first component of the multi-component composition;

a first outlet conduit leading away from the first compartment;

a second compartment containing a second component of the multi-component composition; and a second outlet conduit leading away from the second compartment;

an orifice located on the housing, the orifice being fluidly coupled to the first compartment by the first outlet conduit and fluidly coupled the second compartment by the second outlet conduit;

a common electrical drive mechanism that simultaneously dispenses the first and second components of the multi-component composition from the first and second compartments through the orifice;

an actuating button operably coupled to the common electrical drive mechanism by a rigid stem, wherein:

the actuating button is positioned on the housing beneath the orifice, the actuating button comprises an upper surface having a cradle construction that receives a head of a toothbrush; and the rigid stem extends from the common electrical drive mechanism to the actuating button, upon positioning the lower surface of a head of the toothbrush onto the upper surface of the actuating button and pressing downwardly, the common electrical drive mechanism is powered on and the multi-component composition is dispensed through the orifice directly onto the the head of the toothbrush.

26. A dispensing apparatus for dispensing a composition, the apparatus comprising:

a housing having a lower portion and an upper portion that are detachably coupled together;

a cartridge assembly positioned within the upper portion of the housing, the cartridge assembly containing a composition;

an orifice fluidly coupled to the cartridge assembly and located on the upper portion of the housing;

an electrical drive mechanism located within the lower portion of the housing that dispenses the composition from the cartridge assembly through the orifice;

an actuating button positioned on the upper portion of the housing; and a rigid stem extending from the electrical drive mechanism to the actuating button, the rigid stem coupling the actuating button to the electrical drive mechanism so that actuation of the actuating button transitions the electrical drive mechanism between an on state and an off state.

* * * * *